US006881006B1

(12) United States Patent
Lange

(10) Patent No.: US 6,881,006 B1
(45) Date of Patent: Apr. 19, 2005

(54) DEVICE AND METHOD FOR REDUCING CONSTRUCTION SITE TRACK OUT

(76) Inventor: Jeffrey M. Lange, 500 E. Vera La., Tempe, AZ (US) 85284

( * ) Notice: Subject to any disclaimer, the term of this patent is extended or adjusted under 35 U.S.C. 154(b) by 0 days.

(21) Appl. No.: 10/211,664

(22) Filed: Aug. 2, 2002

(51) Int. Cl.[7] ..... E01B 23/00
(52) U.S. Cl. ..... 404/15; 238/14
(58) Field of Search ..... 404/19, 34, 35, 404/36, 15; D25/114; 238/14, 10 R

(56) References Cited

U.S. PATENT DOCUMENTS

| | | | | | |
|---|---|---|---|---|---|
| 1,389,400 | A | * | 8/1921 | Tufts | 238/14 |
| 1,574,729 | A | | 2/1926 | Foster | |
| 1,720,461 | A | | 7/1929 | Barrett | |
| 1,815,435 | A | * | 7/1931 | Harding et al. | 238/14 |
| 2,367,917 | A | * | 1/1945 | Arthur | 182/163 |
| 2,382,789 | A | | 8/1945 | Guignon, Jr. | |
| 2,402,090 | A | | 6/1946 | Ruppel | |
| 2,619,289 | A | * | 11/1952 | Plante | 238/14 |
| 2,819,026 | A | | 1/1958 | Leyendecker | |
| 2,912,909 | A | | 11/1959 | Hart | |
| 3,069,090 | A | * | 12/1962 | Ginsberg | 238/14 |
| 3,997,110 | A | * | 12/1976 | Aumont | 238/14 |
| 4,265,399 | A | * | 5/1981 | Covington | 238/14 |
| 4,462,712 | A | | 7/1984 | Penland, Sr. | |
| 4,600,336 | A | | 7/1986 | Waller, Jr. | |
| 4,650,115 | A | | 3/1987 | Fontaine | |
| 4,875,800 | A | | 10/1989 | Hicks | |
| 4,889,444 | A | | 12/1989 | Pouyer | |
| 5,020,937 | A | | 6/1991 | Pouyer | |
| 5,087,149 | A | | 2/1992 | Waller, Jr. | |
| 5,106,226 | A | * | 4/1992 | Fanslow et al. | 404/15 |
| 5,163,776 | A | | 11/1992 | Pouyer | |
| 5,383,742 | A | | 1/1995 | Grace | |
| 5,775,834 | A | * | 7/1998 | Jackson | 404/15 |
| 5,820,294 | A | | 10/1998 | Baranowski | |
| 6,520,420 | B1 | * | 2/2003 | Singh | 238/14 |

* cited by examiner

*Primary Examiner*—Gary S. Hartmann
(74) *Attorney, Agent, or Firm*—Schmeiser, Olsen & Watts

(57) ABSTRACT

A method for shaking vehicles comprising driving them over a series of appropriately spaced-apart, mutually parallel bars to vigorously shake the wheels, undercarriage, and body to free them of dirt, gravel and debris. The apparatus provides bars with the appropriate spacing secured to a frame that is sized to be manipulated by hand by construction workers. A track comprises a frame and the spaced-apart bars attached to the frame. Tracks are flexibly connected end-to-end to form rows and rows are laid in a spaced-apart, mutually parallel configuration to form a shaker that will receive the vehicle to be shaken. The shaker may be deployed onto a bed of aggregate that is sufficiently coarse and open-graded to allow the fallen dirt to sift or be washed through the bed of aggregate. The aggregate may also assist in holding the shaker in place and may provide ramps at the ends of each row.

15 Claims, 4 Drawing Sheets

DEVICE AND METHOD FOR REDUCING CONSTRUCTION SITE TRACK OUT

BACKGROUND OF THE INVENTION

TECHNICAL FIELD

This invention relates generally to a product and method for removing dirt from construction vehicles before they leave the construction site. More specifically, this invention uses vibration frequencies to loosen and remove dirt from such vehicles. The invention also relates to shaking vehicles for other purposes.

BACKGROUND

Construction vehicles leaving construction sites carry a substantial amount dirt, gravel, and other debris from the site out onto adjacent streets, roads, and highways. This dirt, gravel, and other debris is referred to as "track out." Track out has become an environmental and safety issue.

Devices exist for removing the gravel from tire treads by deforming the tire by running it over narrow rectilinear bars secured to a plate. These devices do not disclose removing dirt from the undercarriage or the body of the vehicle. In addition, they accumulate the expelled gravel and dirt in the dirt-removing device which subsequently requires frequent cleaning. The existing devices are also very heavy and require heavy equipment to move them.

SUMMARY OF THE INVENTION

The invention is a series of appropriately spaced-apart bars to vibrate or shake a vehicle to free it of dirt, gravel and debris. The apparatus is essentially a track which provides bars with the appropriate spacing secured to a frame that is sized to be manipulated by hand by construction workers. A plurality of tracks may be flexibly connected end-to-end to form a row and rows may be laid in a spaced-apart, mutually parallel configuration to form a device that will receive a vehicle. The device may be deployed onto a bed of aggregate that is sufficiently coarse and open-graded to allow the fallen dirt to sift or be washed into the bed of aggregate. The aggregate may also assist in holding the shaker in place and may serve as a ramp at the ends of each row. In an appropriate application, the frames may be unnecessary, and the bars may be fixed in position without the frames.

BRIEF DESCRIPTION OF THE DRAWINGS

The foregoing and other features and advantages of the invention will be apparent from the following more particular description of specific embodiments of the invention, as illustrated in the accompanying drawings, wherein.

DETAILED DESCRIPTION OF EMBODIMENTS OF THE INVENTION

Figure 1A:
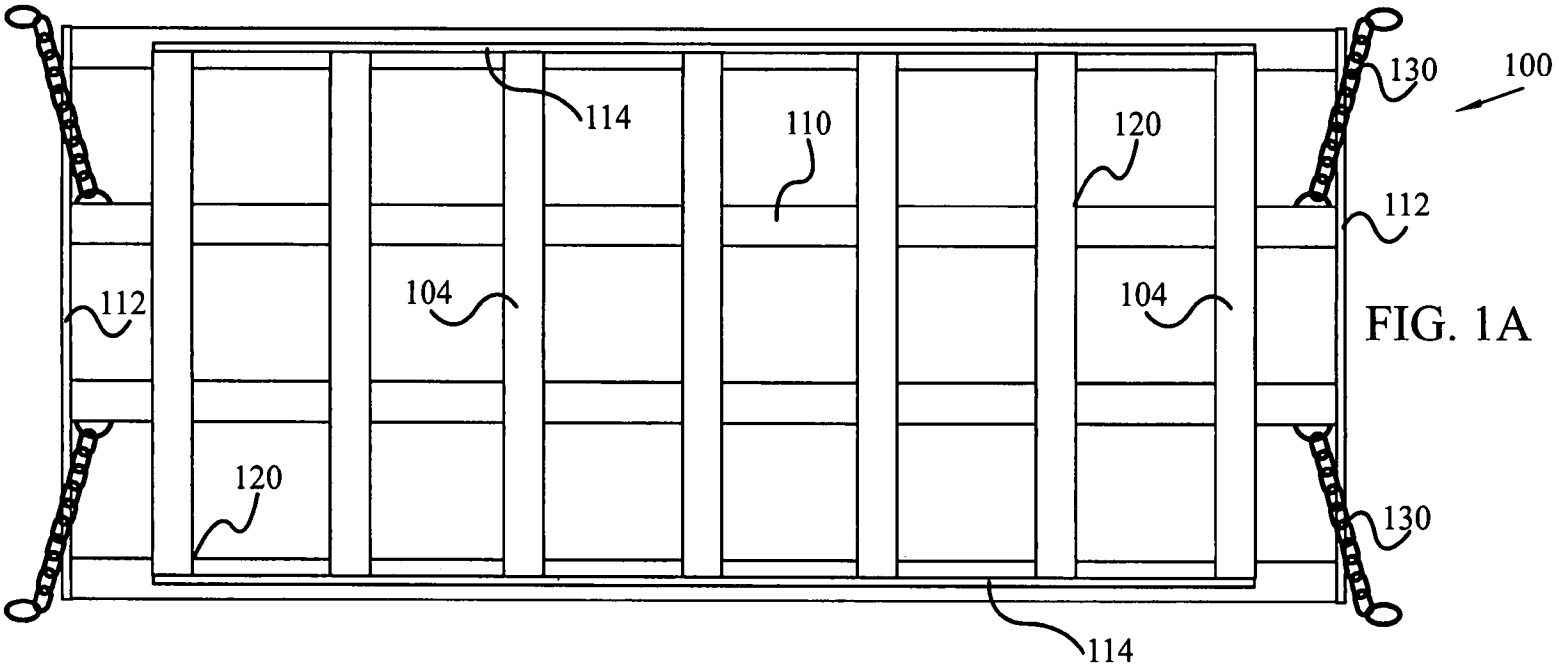
FIG. 1A is top view of the invention.
Figure 1B:
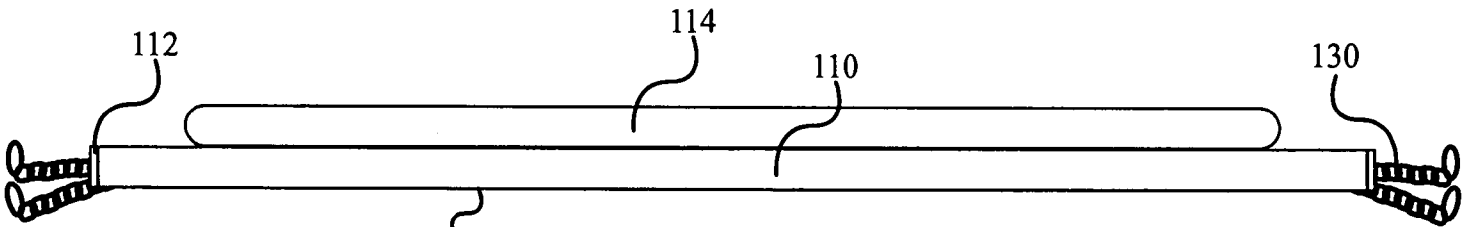
FIG. 1B is a side elevational view of the invention.
Figure 2A:
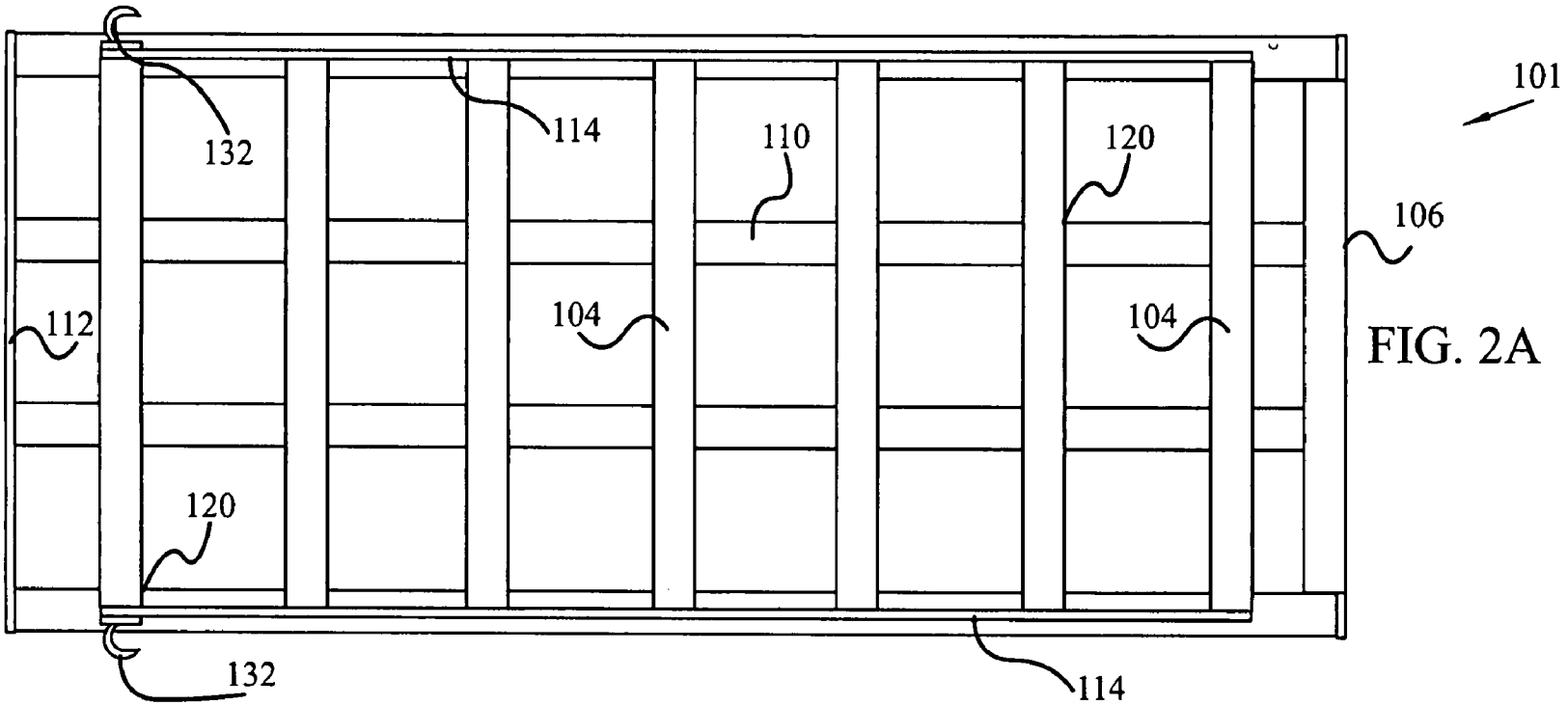
FIG. 2A is a top plan view of an alternate embodiment of the invention.
Figure 2B:
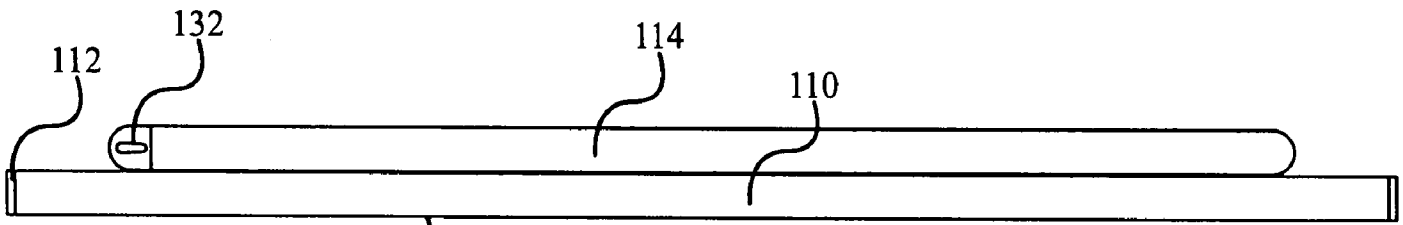
FIG. 2B is a side elevational view of the embodiment of FIG. 2A.

In an embodiment of the invention illustrated in FIGS. 1A and 1B, a track 100 for receiving moving vehicles comprises a frame 102 with a plurality of mutually parallel spaced-apart crossbars 104 attached to the top of the frame 102. In an embodiment, a track may be an open, ladder-like grid. In the illustrated embodiment, the frame 102 comprises four spaced-apart mutually parallel frame members 110 attached by their aligned ends abutted to and welded to rectangular end bars 112. The end bars 112 may abut similar end frame members 110 on other tracks 100 and 101 (FIG. 2) when the tracks 100 and 101 are assembled into rows. The frame members 110 are further connected by a plurality of crossbars 104 attached by welding to each point of contact 120 between the frame members 110 and the crossbars 104. In FIG. 1A, two such points of contact 120 are illustrated as examples. In the illustrated embodiment, the crossbars 104 and frame members 110 are pipes. The ends of the crossbars 104 are abutted to and welded to side bars 114 which are themselves welded along the top of the outer frame members 110. Chains 130 are attached to provide a flexible connection to other tracks 101 (FIG. 2) when forming a row. Also, in some embodiments, the chains 130 may be used with stakes to secure the track 100 in place. In the embodiment illustrated, the track of FIG. 1 may be the middle of three tracks 100, 101 in a row 320 (FIG. 3), wherein the chains 130 of the middle track 100 connect to the hooks 132 of the end tracks 101 (FIG. 2).

Those with skill in the art will appreciate that many types of bars 104, 110, 112, and 114 in addition to pipes may serve as frame members 110, crossbars 104, end bars 112, and side bars 114. The bars 104, 112, and 114 and frame members 110 require sufficient strength to withstand the forces delivered by the shaking vehicles while minimizing the weight of the track 100. In an embodiment, the bars 104, 112, and 114 and frame members 110 are substantially rigid. In another embodiment, bars 104, 112, and 114 and frame members 110 are slightly resilient. In an embodiment, schedule 80 steel pipe with an outside diameter of 2⅜" has served well for frame members 110 and crossbars 104 along with ¼" by 2½" steel bar for end bars 112 and side bars 114. Such an embodiment weighs less than 300 pounds for a track 100, 101 eight feet long and forty-two inches wide. Consequently, the track 100, 101 may be safely lifted by a crew of four construction workers.

Those with skill in the art will also appreciate that welding is only one method of attaching the bars 104, 112, and 114 and frame members 110 together. In an embodiment, the track 100, 101 may be cast as one piece, eliminating the need for welding. In another embodiment, the bars 104, 112, and 114 and frame members 110 may be bolted together. Non-metal materials, such as ceramics, may be used and could require laser fusing or may be connected when fired. In yet another embodiment, the ends of the crossbars 104 need not abut side bars 114. Those skilled in the art will recognize that many materials and methods of joining those materials are possible.

The choice of spacing between crossbars 104 requires special attention. Different vehicles have wheels of different sizes, wheel bases of different lengths, and suspensions with different damping responses. A shaker can usually be optimized for only one set of vehicle features. However, the shaker of the present invention does not have to operate optimally to operate effectively. There are a number of factors to consider in deciding what spacing to use for effective shaking. Experience has shown that, for the embodiment described above using 2⅜" pipe for crossbars 104, a uniform spacing of 14" between the longitudinal axes of the crossbars 104 provides effective shaking for a large variety of construction vehicles. Of course, fourteen inches would not be an ideal crossbar 104 spacing for smaller vehicles where the wheels would not sufficiently span the distance between adjacent crossbars 104. Based on this experience, a spacing that is 1/(3.15) times the tire diameter for the vehicles of interest is effective. In an embodiment where vehicles of significantly different sizes (i.e., small pickup trucks and earth movers) are to be shaken, two or more separate shakers, each with crossbar 104 spacing sized for a representative tire diameter, may be used. Alternatively, as diagrammatically shown in FIGS. 4 and 5, a track may have non-uniform spacing between the crossbars 104 to accommodate a wider variety of wheel sizes, as will be explained in greater detail below.

Figure 3:
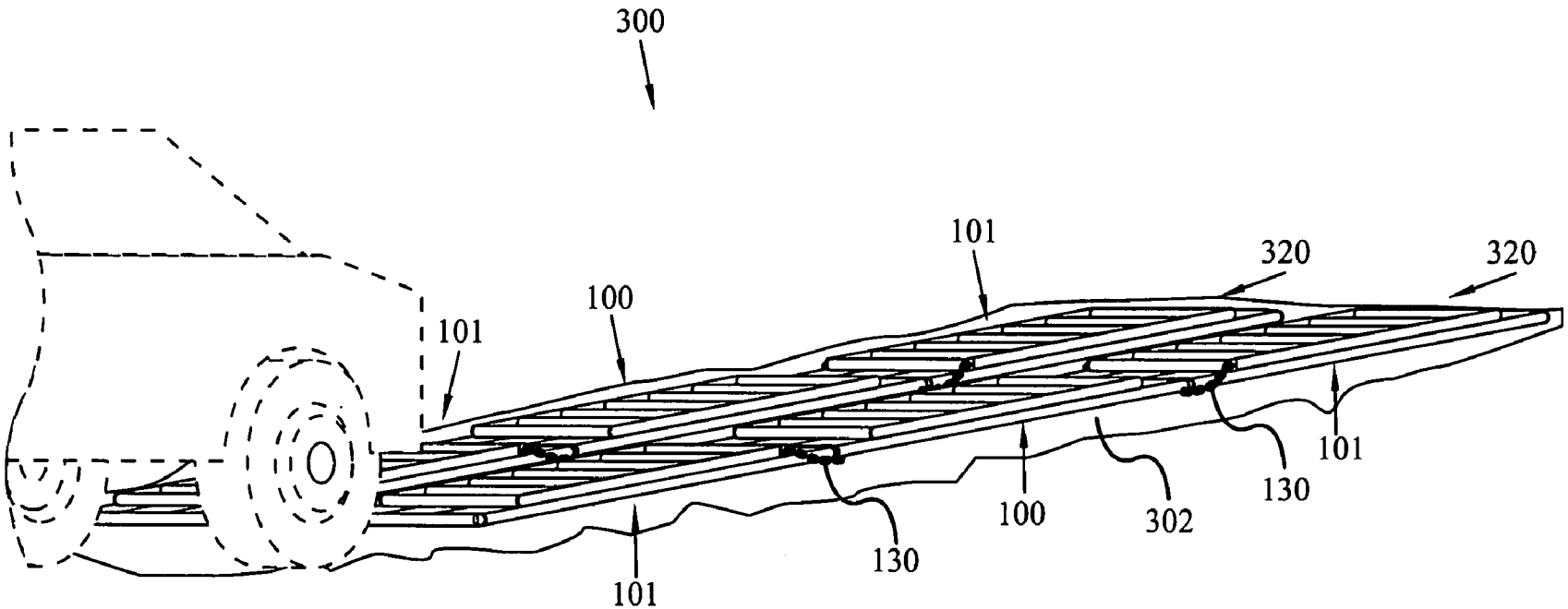
FIG. 3 is a perspective view of the invention in situ.
Figure 4:
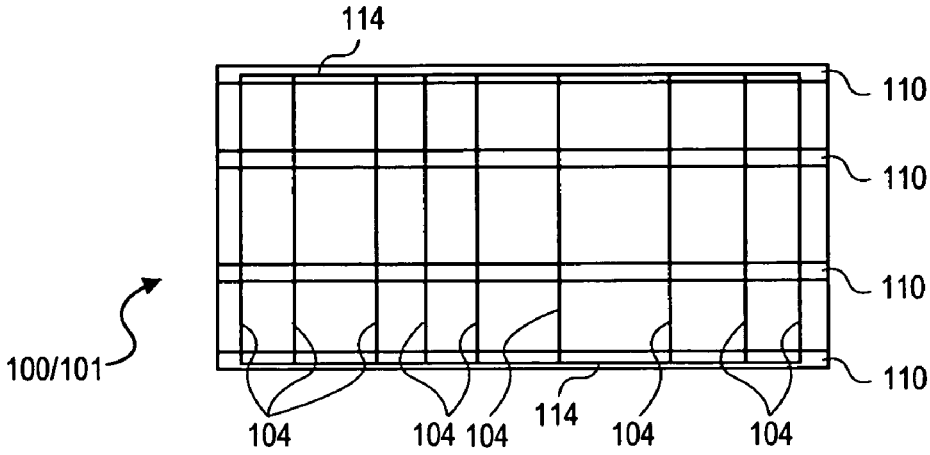
FIG. 4 is a diagrammatic top plan view of the tracks of FIGS. 1A and 2A in accordance with one aspect of the invention.
Figure 5:
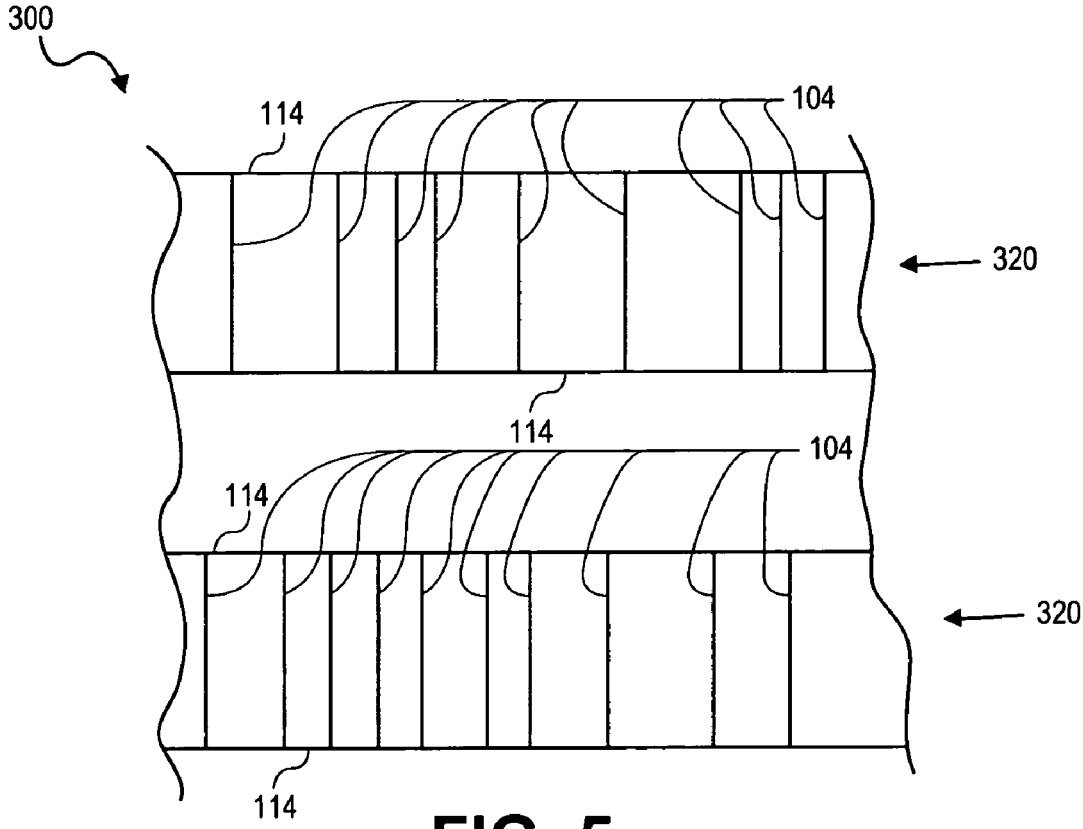
FIG. 5 is a diagrammatic top plan view of a shaker incorporating the tracks of FIG. 3.

In other embodiments, as shown in FIGS. 4 and 5, the crossbar 104 spacing is not uniform. Excitation of harmonic vibration modes in the vehicle body and undercarriage can contribute to shaking. Each vehicle has different vibration modes, and even those modes may change depending on how an individual vehicle is loaded. The suspension of a vehicle is essentially a spring-mass-damper system. The excitation of harmonic vibrations is driven by the frequency at which the wheels hit the crossbars 104. Thus, the excitation frequency is a function of vehicle speed and crossbar 104 spacing. By using non-uniform crossbar 104 spacing, a larger span of frequencies may be excited, increasing the chances of exciting a harmonic useful for shaking. Thus, the crossbar 104 spacing on a given track 100, 101 may not be uniform, or a row 320 (FIG. 3) of tracks 100, 101 may be formed wherein each track 100, 101 has a different uniform or non-uniform spacing. Also, the shaker may have rows where the crossbar 104 spacing in one row is different than the crossbar 104 spacing in the other, parallel row, as diagrammatically depicted in FIG. 5. Those skilled in the art will appreciate the many possible combinations of crossbar 104 spacings to excite a variety of frequencies.

In one application where the crossbar 104 spacing is uniform, the speed of the vehicle is varied to excite a range of frequencies. For example, a truck can accelerate or decelerate continuously while traveling the length of the shaker. Similarly, the truck could accelerate or decelerate while traveling the length of a shaker having non-uniform crossbar 104 spacing. In such an application, the driver learns from experience which speed produces the best shaking for his vehicle and the ground conditions.

In an embodiment, uniform crossbar 104 spacing is selected to be an integer divisor of the length of the wheel base of a vehicle with at least two axles. This crossbar 104 spacing may cause the wheels of the front axle and the wheels of the rear axle to impact the crossbars 104 at the same time. This will cause both ends of the vehicle to move up simultaneously and then to fall simultaneously after crossing the crossbar 104. The effect will be to cause the vehicle to shake by hopping up and down. In another embodiment, the crossbar 104 spacing is selected to not be an integer divisor of the length of the wheelbase of any vehicle. In this embodiment, the front and back ends will raise and fall at different times, thereby shaking with a teetering-back-and-forth effect. In a more complicated embodiment, the shaker has crossbars 104 spaced non-uniformly to create hopping-up-and-down shaking at least once for each of a plurality of vehicles with different wheel bases.

In other variations, the crossbars 104 in one row of the shaker are not co-linear with the crossbars 104 in other rows of the shaker, as diagrammatically depicted in FIG. 5. In an embodiment that uniformly excites hopping, non-co-linear crossbars will cause first one side and then the other side of the vehicle to hop, thereby creating additional side-to-side teetering-type shaking. When the crossbar 104 spacing is selected to cause back-and-forth teetering, non-co-linear crossbars 104 will provide both front-to-back and side-to-side shaking of the teetering-back-and-forth type.

As illustrated in FIG. 2, an end bar 112 may be round in cross-section. In this embodiment, the end bar 112 is configured with the nearest crossbar 106 and the frame 102 to form a ramp. Note that crossbar 106 may be mechanically the same as crossbars 104, but is separately identified for convenience. Forming a ramp with the nearest crossbar and the frame may be advantageous in situations where ramps of aggregate 302 (FIG. 3) are not appropriate or not available. The ramp may also reduce the horizontal component of the force applied by the moving vehicle to the track 101.

In an embodiment illustrated in FIG. 3, the shaker 300 may be deployed on aggregate 302. A plurality of tracks 100, 101 may be laid end-to-end in rows 320 or a single track may be used. The rows 320 are deployed spaced apart and mutually parallel to form a shaker 300. The aggregate 302 may serve multiple purposes. For example, where the aggregate 302 is an open-graded aggregate 302, a plurality of channels are created through which fallen dirt can pass. Open-graded aggregate 302 has a gap in the grade-sizes of material it contains, thereby creating unfilled spaces between the stones. The open-graded aggregate 302 may be a single-grade aggregate 302. In operation, the fallen dirt is sifted downward by the vibration of the shaker 300 mechanically transmitted to the aggregate 302. If the dirt is mud, clay, or otherwise adhesive, the dirt that falls from the vehicle onto the open-graded aggregate 302 may be washed downward by a construction worker using a water hose. Aggregate 302 may be used to secure the shaker 300 in place by being graded against the side bars 114 and the frame members 110. The aggregate 302 may also be graded against the end bars 112 of the tracks 100 at the ends of each row 310 to form ramps up to the level of the crossbars 104 of the shaker 300. In the embodiment above using 2⅜" pipe, experience has shown that a single-graded 1.5" aggregate 302 is suitable for securing, sifting, and ramping functions. In another embodiment, the frame 102 is buried in aggregate 302 and the crossbars 104 and 106 are supported by the aggregate.

Alternatively, the tracks 100 of the shaker 300 may be secured in place with chains 130 connected to stakes driven into the ground. Of course, the tracks 100 of the shaker 300 could be secured in place with chains 130 connected to immovable objects.

An embodiment of the shaker 300 may be used for settling loads of gravel in a truck loaded with gravel. Typically, loads of gravel are settled by the motion of the truck on the road. This can lead to shifted loads and spillage, particularly from a loose load reacting to a sharp turn. By shaking the load at the gravel pit and before moving the truck onto public roads, the load is packed tighter and shifting and spillage may be reduced. Those skilled in the art of trucking will appreciate other loads that can benefit from settling before transit.

The foregoing description has described selected embodiments of a shaker 300 for shaking vehicles.

While the invention has been particularly shown and described with reference to selected embodiments thereof, it will be readily understood by one of ordinary skill in the art that, as limited only by the appended claims, various changes in form and details may be made therein without departing from the spirit and scope of the invention.

I claim:

1. An apparatus for removing track-out from a moving vehicle, comprising:

a frame, adapted to be placed on the ground, said frame comprising:

a plurality of parallel frame members rigidly connected to each other at their ends by a plurality of end bars; and a plurality of cross bars connected to each other by side bars, the plurality of crossbars fixed to the frame members at least in part by the side bars disposed on top of the frame members in a spaced-apart relationship to each other, whereby the vehicle having its wheels traveling over the crossbars at a predetermined speed will move from one crossbar to an adjacent crossbar causing the vehicle to vibrate and wherein the spacing between at least some of the adjacent crossbars is between nine inches and fifty inches.

2. The apparatus of claim 1 wherein the spacing of the crossbars is non-uniform.

3. The apparatus of claim 1 wherein the crossbars are fixed in respective positions on the frame to provide a track having specific shaking characteristics.

4. The apparatus of claim 3 wherein:

the track is a first track of a plurality of tracks; and each track has an open grid pattern with specific shaking characteristics.

5. The apparatus of claim 3 wherein the crossbars are transverse to the frame members of each respective frame.

6. The apparatus of claim 3 wherein:

the track is one of a plurality of tracks;

the plurality of tracks are configured in a plurality of mutually parallel, spaced-apart rows; and the plurality of crossbars are transverse to the lengths of the rows and the distance between the rows is suitable to receive moving vehicle wheels onto at least one row and to receive the remaining wheels of the moving vehicle onto the remainder of the plurality of rows.

7. The apparatus of claim 6 wherein at least one track in at least one row is separably and flexibly connected to at least one adjacent track.

8. The apparatus of claim 1 further comprising aggregate dispersed beneath the frame.

9. The apparatus of claim 8 wherein the aggregate is of sizes and shapes to form channels into the aggregate to allow dirt shaken from the vehicle to pass into the channels.

10. The apparatus of claim 8 wherein the aggregate is arranged to provide at least one ramp to at least one end of the frame.

11. The apparatus of claim 1 wherein the spacing of the crossbars on each track is uniform.

12. A plurality of apparatuses of claim 2, further comprising a plurality of frames including the frame, wherein the frames are configured in a plurality of substantially parallel, spaced-apart rows, the crossbars configured transverse to the lengths of the rows, and the distance between the rows is configured to receive all of the moving vehicle wheels onto the plurality of rows.

13. The apparatus of claim 12 wherein the plurality of frames comprise at least two frames and the spacing between crossbars on each frame is unique to that frame.

14. The apparatus of claim 12 wherein at least one crossbar in any row of frames is not collinear with any crossbar in any other row.

15. The apparatus of claim 1 wherein the spacing between the crossbars is between nine inches and twenty inches.

* * * * *

US006881006C1

(12) EX PARTE REEXAMINATION CERTIFICATE (9698th)

United States Patent
Lange

(10) Number: US 6,881,006 C1
(45) Certificate Issued: Jun. 6, 2013

(54) DEVICE AND METHOD FOR REDUCING CONSTRUCTION SITE TRACK OUT

(75) Inventor: Jeffrey M. Lange, Tempe, AZ (US)

(73) Assignee: Trackout Industries, LLC, Tempe, AZ (US)

Reexamination Request:
No. 90/012,420, Aug. 8, 2012

Reexamination Certificate for:

| | |
|---|---|
| Patent No.: | **6,881,006** |
| Issued: | **Apr. 19, 2005** |
| Appl. No.: | **10/211,664** |
| Filed: | **Aug. 2, 2002** |

(51) Int. Cl.
*E01B 23/00* (2006.01)

(52) U.S. Cl.
USPC ..... 405/15; 238/14

(58) Field of Classification Search
None
See application file for complete search history.

(56) References Cited

To view the complete listing of prior art documents cited during the proceeding for Reexamination Control Number 90/012,420, please refer to the USPTO's public Patent Application Information Retrieval (PAIR) system under the Display References tab.

*Primary Examiner* — Patricia Engle

(57) ABSTRACT

A method for shaking vehicles comprising driving them over a series of appropriately spaced-apart, mutually parallel bars to vigorously shake the wheels, undercarriage, and body to free them of dirt, gravel and debris. The apparatus provides bars with the appropriate spacing secured to a frame that is sized to be manipulated by hand by construction workers. A track comprises a frame and the spaced-apart bars attached to the frame. Tracks are flexibly connected end-to-end to form rows and rows are laid in a spaced-apart, mutually parallel configuration to form a shaker that will receive the vehicle to be shaken. The shaker may be deployed onto a bed of aggregate that is sufficiently coarse and open-graded to allow the fallen dirt to sift or be washed through the bed of aggregate. The aggregate may also assist in holding the shaker in place and may provide ramps at the ends of each row.

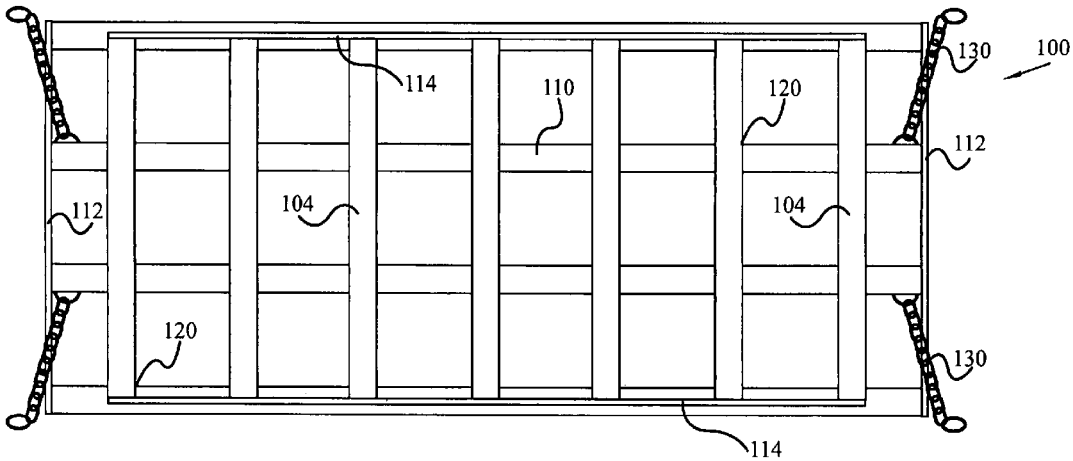

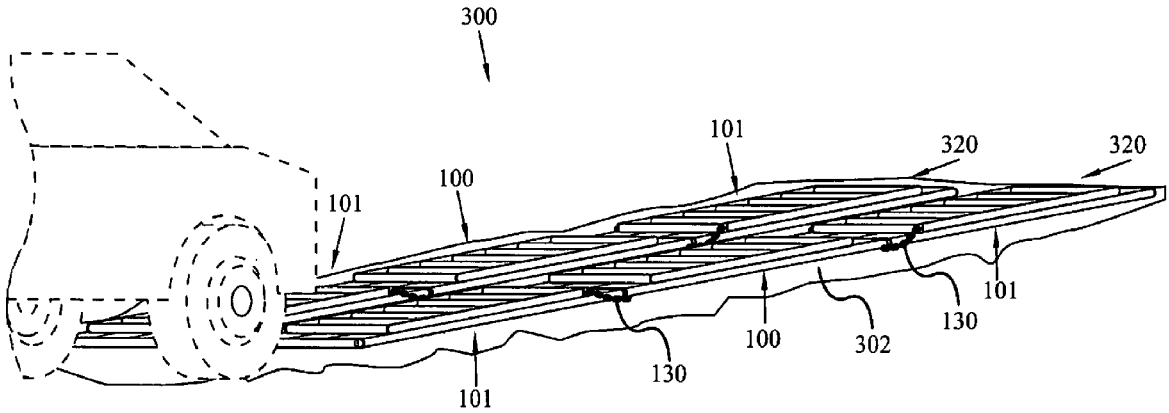

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 11 are cancelled.

Claims 1 and 12 are determined to be patentable as amended.

Claims 3-10 and 13-15, dependent on an amended claim, are determined to be patentable.

1. An apparatus for removing track-out from a moving vehicle, comprising:

a frame, adapted to be placed on the ground, said frame comprising:

a plurality of parallel frame members rigidly connected to each other at their ends by a plurality of end bars; and a plurality of cross bars connected to each other by side bars, the plurality of crossbars fixed to the frame members at least in part by the side bars disposed on top of the frame members in a spaced-apart relationship to each other, whereby the vehicle having its wheels traveling over the crossbars at a predetermined speed will move from one crossbar to an adjacent crossbar causing the vehicle to vibrate and wherein the spacing between at least some of the adjacent crossbars is between nine inches and fifty inches *and further wherein the spacing of the crossbars is non-uniform*.

12. A plurality of apparatuses of claim [2]*1*, further comprising a plurality of frames including the frame, wherein the frames are configured in a plurality of substantially parallel, spaced-apart rows, the crossbars configured transverse to the lengths of the rows, and the distance between the rows is configured to receive all of the moving vehicle wheels onto the plurality of rows.

* * * * *